US009164460B2

(12) United States Patent
Tsukada

(10) Patent No.: US 9,164,460 B2
(45) Date of Patent: Oct. 20, 2015

(54) IMAGE FORMING APPARATUS HAVING TONE DENSITY CORRECTION

(71) Applicant: CANON KABUSHIKI KAISHA, Tokyo (JP)

(72) Inventor: Yoshiro Tsukada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/965,245

(22) Filed: Aug. 13, 2013

(65) Prior Publication Data

US 2014/0064757 A1 Mar. 6, 2014

(30) Foreign Application Priority Data

Aug. 30, 2012 (JP) ..... 2012-190040

(51) Int. Cl.
*G03G 15/00* (2006.01)

(52) U.S. Cl.
CPC ..... *G03G 15/556* (2013.01); *G03G 15/5041* (2013.01)

(58) Field of Classification Search
CPC ..... G03G 15/5041; G03G 15/556
USPC ..... 399/49, 58, 72, 73, 74
See application file for complete search history.

(56) References Cited

U.S. PATENT DOCUMENTS

| | | | | |
|---|---|---|---|---|
| 2004/0223776 | A1* | 11/2004 | Ishida | 399/49 |
| 2008/0152370 | A1* | 6/2008 | Akita | 399/49 |
| 2011/0255890 | A1* | 10/2011 | Zaitsu et al. | 399/48 |
| 2013/0202318 | A1* | 8/2013 | Ariizumi | 399/27 |
| 2013/0259502 | A1* | 10/2013 | Motomura | 399/50 |
| 2013/0279927 | A1* | 10/2013 | Kihara et al. | 399/50 |

FOREIGN PATENT DOCUMENTS

| | | | |
|---|---|---|---|
| JP | 63240568 | A | * 10/1988 |
| JP | 2001075342 | A | * 3/2001 |
| JP | 2001-117297 | A | 4/2001 |
| JP | 2008-83252 | A | 4/2008 |
| JP | 2010-107856 | A | 5/2010 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes an image bearing member, a development device that develops an electrostatic latent image as a toner image using a toner, a density sensor that irradiates a controlling image and detects reflection from the controlling image, and a controller that forms controlling images on the image bearing member. The controller decides whether a mode for correcting toner density is performed or not according to both detection results of a first controlling image formed by developing the electrostatic latent image with the development device, the electrostatic latent image formed by exposing a surface of the image bearing member by an exposure device, and a second controlling image formed by developing with the development device without substantially performing exposure to the surface of the image bearing member by the exposure device.

6 Claims, 12 Drawing Sheets

FIG. 7

| | DIGITAL DEVELOPMENT | ANALOG DEVELOPMENT |
|---|---|---|
| MERIT | WHEN THERE IS POTENTIAL SENSOR,<br>DEVELOPMENT CONTRAST IS CONST<br>IT IS HARDLY AFFECTED BY MECHANICAL CHANGE<br>SAME STATE AS THAT OF NORMAL IMAGE FORMING TIME | EVEN WHEN THERE IS NO POTENTIAL SENSOR,<br>DEVELOPMENT CONTRAST IS ENSURED<br>(BRIGHT POTENTIAL VL CHANGE DOES NOT MATTER) |
| DEMERIT | WHEN THERE IS NO POTENTIAL SENSOR,<br>THERE IS CASE WHERE CHANGE OCCURS IN<br>IMAGE DENSITY<br>(SUSCEPTIBLE TO LATENT IMAGE POTENTIAL VL CHANGE) | SINCE DEVELOPMENT CONTRAST IS SMALL,<br>IT IS SUSCEPTIBLE TO MECHANICAL CHANGE |

*FIG. 9*

| | | | | |
|---|---|---|---|---|
| DIGITAL DENSITY CHANGE | NO | NO | YES | YES |
| ANALOG DENSITY CHANGE | YES | NO | NO | YES |
| ACTUAL DENSITY CHANGE | NO | NO | NO | YES |

*FIG. 10*

| | | DIGITAL PATCH DENSITY | |
|---|---|---|---|
| | | CHANGE | NO CHANGE |
| ANALOG PATCH DENSITY | CHANGE | (1) IMAGE DENSITY (TONE) CORRECTION CONTROL | (2) UNEVENNESS CORRECTION |
| | NO CHANGE | (3) DEVIATION OF EXPOSURE PORTION POTENTIAL VL BASED ON TEMPERATURE IS CORRECTED | (4) NO CONTROL |

IMAGE FORMING APPARATUS HAVING TONE DENSITY CORRECTION

BACKGROUND OF THE INVENTION

1. Field of the Invention

The present invention relates to an image forming apparatus such as a copying machine, a printer, and a facsimile.

2. Description of the Related Art

In an image forming apparatus in which toner is frictionally charged to develop a latent image on a photoreceptor, a charging amount of the charged toner is not always constant, the toner is naturally neutralized when an image forming apparatus body is not operated and is left, and the charging amount of the toner is gradually decreased. For this reason, after the image forming apparatus body is turned off, when the image forming apparatus body is operated after time elapses to some extent, the charging amount of the toner is decreasing, and thus an image density increases.

In a conventional image forming apparatus, at the time of power-on, a predetermined patch image is formed on an intermediate transfer member or a photoreceptor, and an image density thereof is read using an optical reflection detection sensor or the like. When the image density deviates by the extent equal to or more than a predetermined degree, tone correction is performed. Specifically, a patch having a plurality of density levels is formed, and a tone density is corrected based on a density of a plurality of patch images.

As the image density, there are density correction based on a digital patch and density correction based on an analog patch (see Japanese Patent Laid-Open No. 2001-117297). Here, the digital patch means a patch image formed by performing exposure based on an exposure unit and development based on a development unit after an image bearing member is charged. The analog patch means a patch image formed by changing a difference between a development voltage of the development based on the development unit and a charging potential of the image bearing member without performing the exposure based on the exposure unit.

A latent image potential of the photoreceptor, particularly, a bright potential is changed according to a temperature and a durable state. For this reason, in detection of the change of the image density based on the digital patch, when a potential sensor capable of measuring the potential of the photoreceptor is mounted, it is possible to form the patch image at a constantly accurate development contrast, and thus it is possible to accurately detect the density change. However, when the potential sensor is not mounted, the patch image is formed at a slightly different image contrast each time. As a result, although an actual digital patch density is temporarily changed but the density is not changed essentially, it may be detected that the density is changed.

In the detection of the change of the image density based on the analog patch, since the density change is detected in a state where there is no bright potential, it is possible to detect the change of the actual density purely based on the change of the charging amount of the toner without receiving an influence of the change of the bright potential. However, generally, when the analog patch is output, image density unevenness easily occurs due to mechanical change since the analog patch is output at a contrast smaller than a contrast of the digital image. When the image is actually output, the image is formed on a predetermined screen in a digital manner but not an analog manner. For this reason, the change of the image density may be different from the change of the image density actually output onto a sheet.

As described above, even when the change of the image density is performed at any of the analog manner and the digital manner, it may be erroneously detected that the image density is changed even when the change of the density does not actually occur, and image density correction adjustment (tone correction) may be performed. When the image density correction adjustment (the tone correction) is performed on all density tones and all screen patterns, a lot of time and toner are consumed. For this reason, in such detection of the change of the density, it is preferentially required to detect that the density is actually changed.

SUMMARY OF THE INVENTION

It is desirable to provide an image forming apparatus which can efficiently achieve start-up and printing start of an image forming apparatus body in a short time and stabilization of an image density.

According to an aspect of the invention, there is provided an image forming apparatus which forms a patch image with a plurality of different density levels, and is capable of performing a mode of correcting a tone density based on a density of the patch image, the image forming apparatus including: an image bearing member; a charging device that charges the image bearing member; an exposure device that exposes the image bearing member to form an electrostatic latent image; a development device that develops the electrostatic latent image as a toner image using toner; a detection portion that detects a density of the toner image formed on the image bearing member; and a controller that determines whether to perform the mode based on a first patch and a second patch, the first patch which is formed by charging the image bearing member based on the development device, exposuring the image bearing member to form the electrostatic latent image based on the exposure device and developing the electrostatic latent image based on the development device, the second patch which is formed by charging the image bearing member based on the development device and performing development based on the development device without substantially performing the exposure based on the exposure device.

Further features of the present invention will become apparent from the following description of exemplary embodiments with reference to the attached drawings.

BRIEF DESCRIPTION OF THE DRAWINGS

FIG. 7 is a diagram illustrating merits and demerits of digital development and analog development;

FIG. 9 is a diagram illustrating an effect of the first embodiment;

FIG. 10 is a diagram illustrating a combination of detection results of a digital patch and an analog patch, and controls thereof;

DESCRIPTION OF THE EMBODIMENTS

First Embodiment

Figure 1:
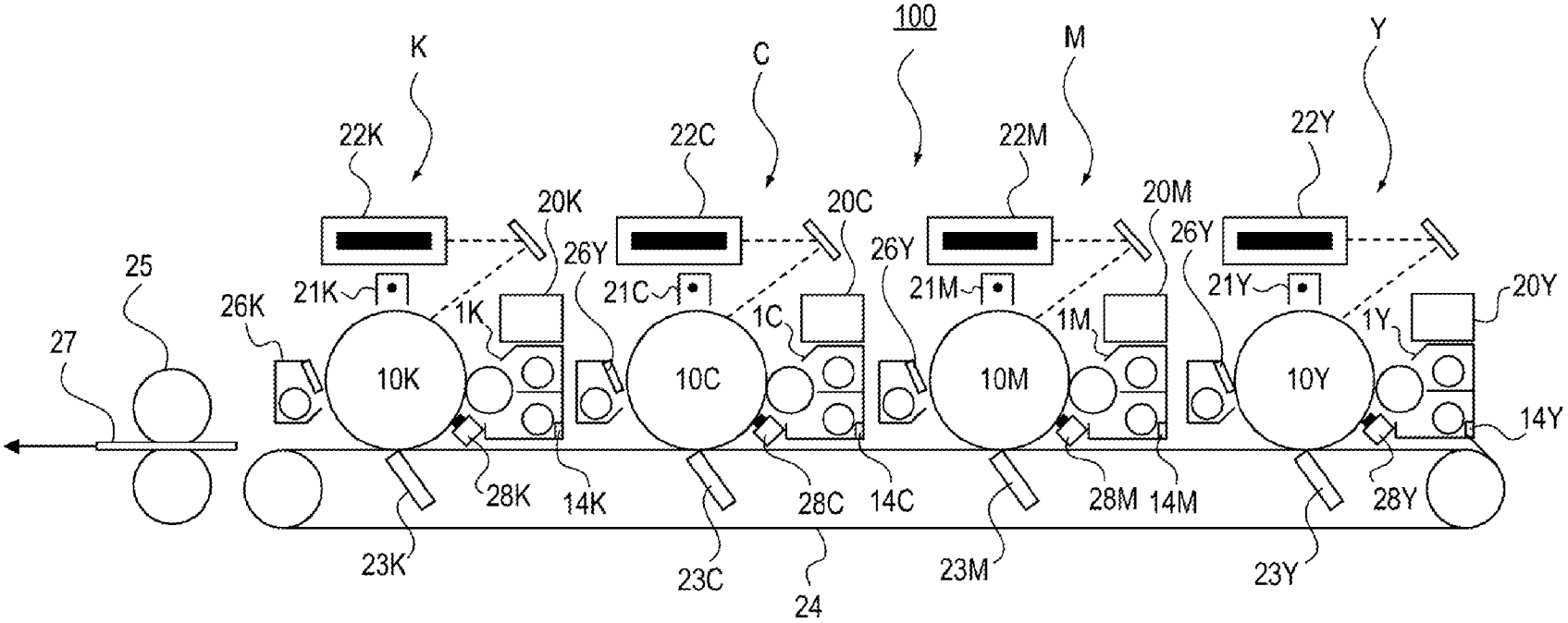
FIG. 1 is a diagram illustrating a configuration of an image forming apparatus according to a first embodiment.

An image forming apparatus according to a first embodiment of the invention will be described with reference to the drawings. FIG. 1 is a diagram illustrating a configuration of the image forming apparatus according to the embodiment.

As illustrated in FIG. 1, in an image forming apparatus 100 of the embodiment, a photoreceptor drum (an image bearing member) 10 is charged by a primary charger (a charging portion) 21 and is exposed by an exposure device 22 according to image information, to form an electrostatic latent image on the image bearing member. The formed electrostatic latent image is developed as a toner image by a development device (a development unit) 1.

The developed toner image is transferred to a sheet 27 conveyed by a sheet conveyor belt 24, by a transfer charger 23. The sheet to which the toner image is transferred is heated and pressurized by a fixation device 25, and the toner image is fixed. A transferring residual toner remaining on the photoreceptor drum 10 after the transferring is removed by a cleaning device 26. The developer (the toner) consumed in the image formation is supplied from a toner supply tank 20.

Figure 2:
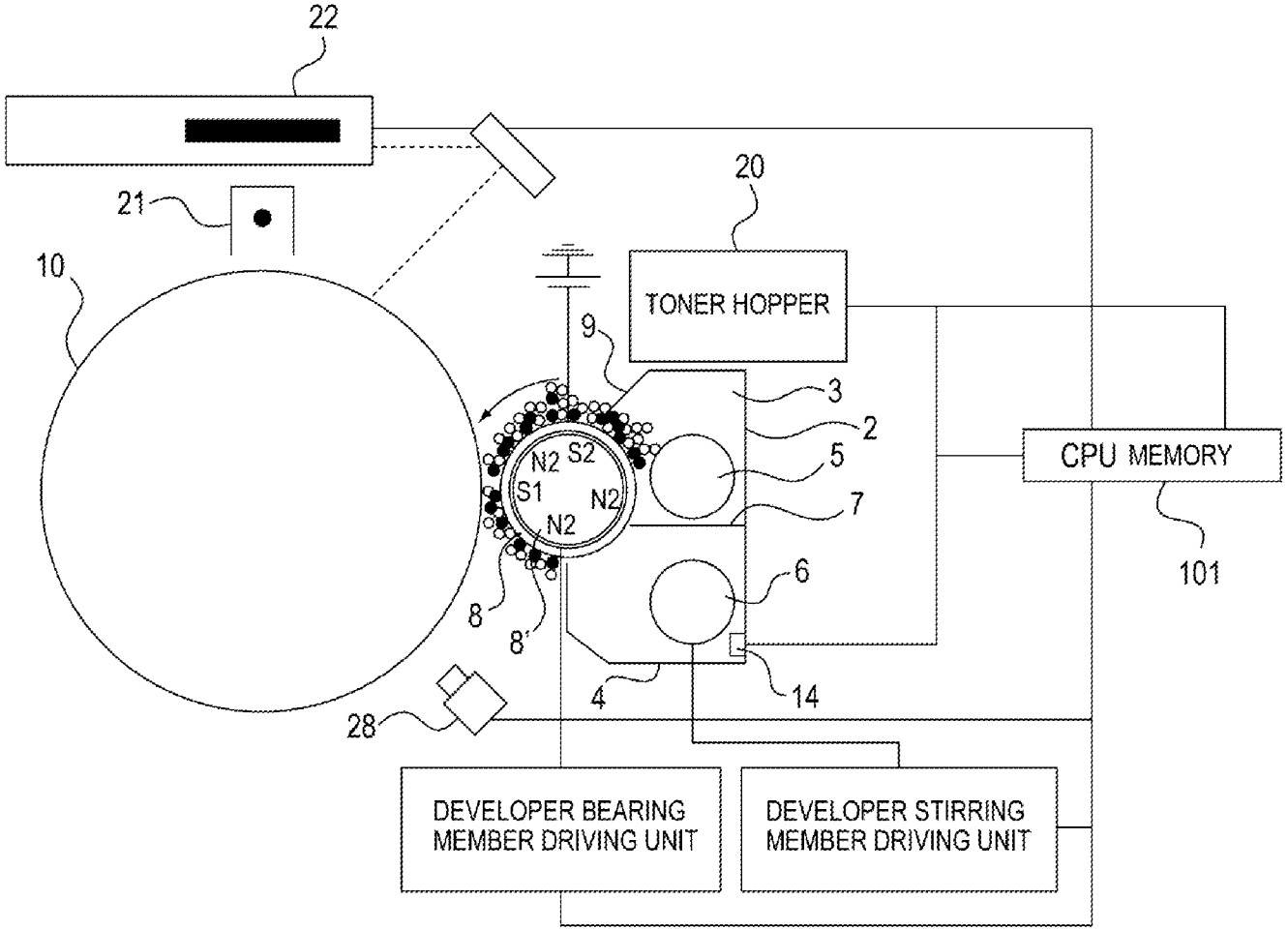
FIG. 2 is a schematic diagram illustrating a development device and a photoreceptor drum according to the embodiment.

FIG. 2 is a schematic diagram illustrating the development device 1 and the photoreceptor drum 10 according to the embodiment. As illustrated in FIG. 2, a two-component developer including toner and a carrier is used in the development device 1. The carrier and the toner are frictionally charged in the development device 1, and thus toner is charged. The developer including the charged toner is transported to the vicinity of the photoreceptor drum 10 by a development sleeve (a developer bearing member) 8. In this case, a bias with the same polarity as that of a photoreceptor potential is applied to the development sleeve 8, the charged toner flies toward the electrostatic latent image on the photoreceptor drum 10 by a potential difference between the development bias and the photoreceptor drum, and thus the development is achieved.

Figure 3:
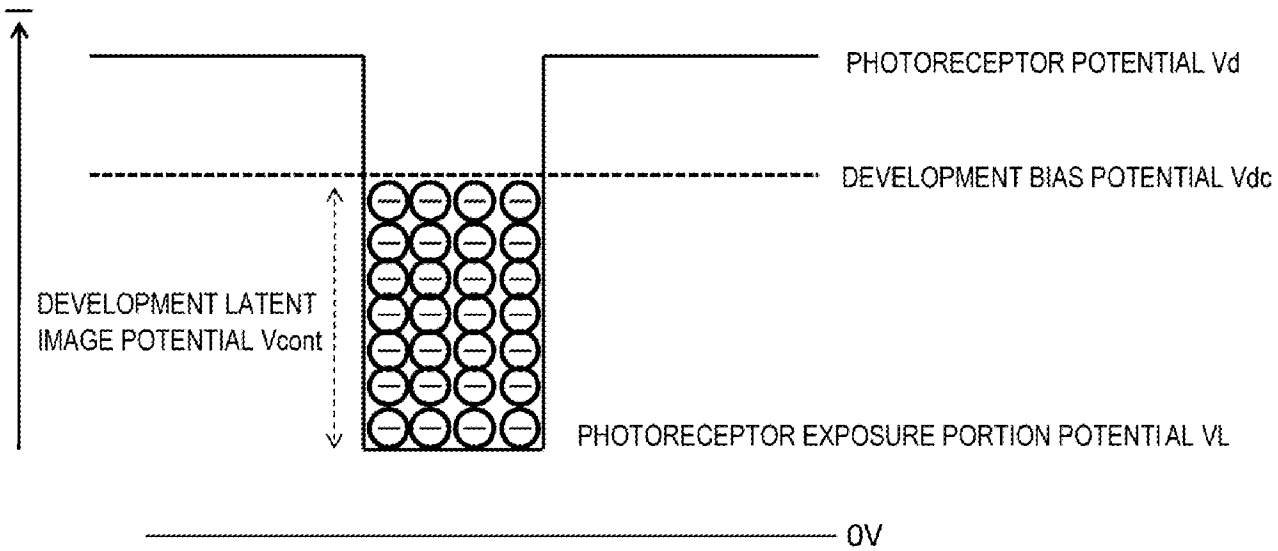
FIG. 3 is a schematic diagram illustrating a development process.

FIG. 3 is a schematic diagram illustrating a development process. As illustrated in FIG. 3, the photoreceptor drum 10 is charged to a negative photoreceptor potential Vd, and the exposed portion is neutralized to 0 V side, to be an exposure portion potential (a latent image potential) VL. Here, Vd is −700 V, and VL is −200 V. A development bias Vdc is a potential between Vd and VL, and here the Vdc is −500 V.

In the above state, the exposure portion potential VL of the photoreceptor drum 10 is relatively closer to a positive potential than the photoreceptor potential Vd or the development bias Vdc. For this reason, the negatively charged toner flies until being the same potential as Vdc with respect to VL of the photoreceptor drum 10.

That is, the toner equivalent to a development latent image potential Vcont that is a difference between the development bias Vdc and the exposure portion potential VL is mounted on the photoreceptor drum 10. For this reason, it is possible to adjust the image density by adjusting the development latent image potential Vcont.

Figure 4:
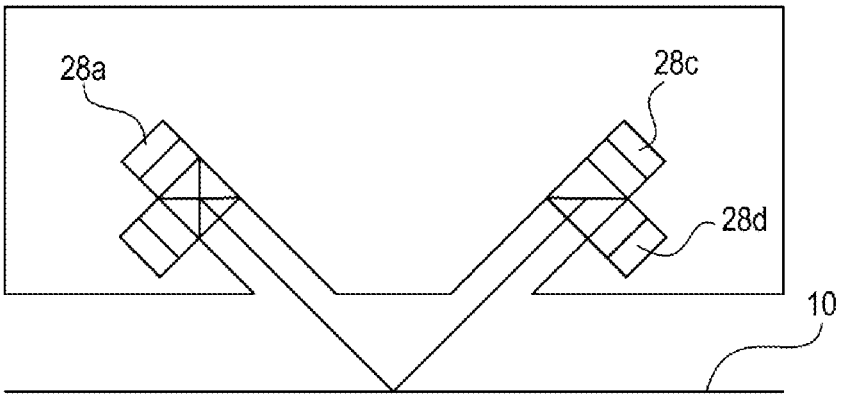
FIG. 4 is a diagram illustrating a configuration of a density detecting sensor.

FIG. 4 is a diagram illustrating a configuration of an image density detecting sensor. As illustrated in FIG. 4, a density detecting sensor 28 determines whether or not it is possible to obtain a desired image density from the amount of the toner on the photoreceptor drum 10. The density detecting sensor 28 irradiates a toner face of the photoreceptor drum by a light emitting element (LED) 28*a*, and detects reflected light received by photodiodes (light receiving elements) 28*c* and 28*d*, to detect the toner density.

As described above, the density of an image to be output is determined by the amount of the toner filling the development latent image potential Vcont. Accordingly, when the charging amount of the toner is decreased, the amount of the flying toner is increased, and the image density is increased. On the contrary, when the charging amount of the toner is increased, the amount of the flying toner is decreased, and the image density is decreased.

Generally, the charging amount of the toner is increased by excessive friction, is decreased by deterioration of the toner or the carrier, is increased or decreased by change of humidity, and is decreased by neutralization due to the toner being left for a long time.

Generally, the increase of the charging amount based on the excessive friction or the decrease of the charging amount based on the deterioration of the toner or the carrier is a parameter which is gradually changed over a long time. For this reason, the parameter is adjusted by a TD ratio that is a ratio of the toner to the carrier of the developer, and it is possible to keep the charging amount of the toner constant.

However, the humidity change or the leaving time is a parameter which is changed in a short time as compared with the former parameter, it is difficult to adjust the parameter by the TD ratio described above, and naturally, the parameter may not be adjusted by the TD ratio when the power of the main body is turned off and the machine stops. Accordingly, when the amount of the toner mounted on the photoreceptor drum 10 is detected by any unit at the time of power-on and is changed from a predetermined amount of the toner, the development latent image potential Vcont has to be adjusted.

(Controller)

As illustrated in FIG. 2, the image forming apparatus 100 includes a controller 101 including a CPU and a memory. The controller 101 controls the development device 1, the exposure device 22, and the like, and performs an image density correction control (tone correction) to be described later based on a fixation temperature and the image density detected by the density detecting sensor 28. The controller 101 forms a patch image with a plurality of different density levels, and can perform a mode of correcting a tone density based on a density of the patch image.

(Conventional Image Density Correction)

Figure 5:
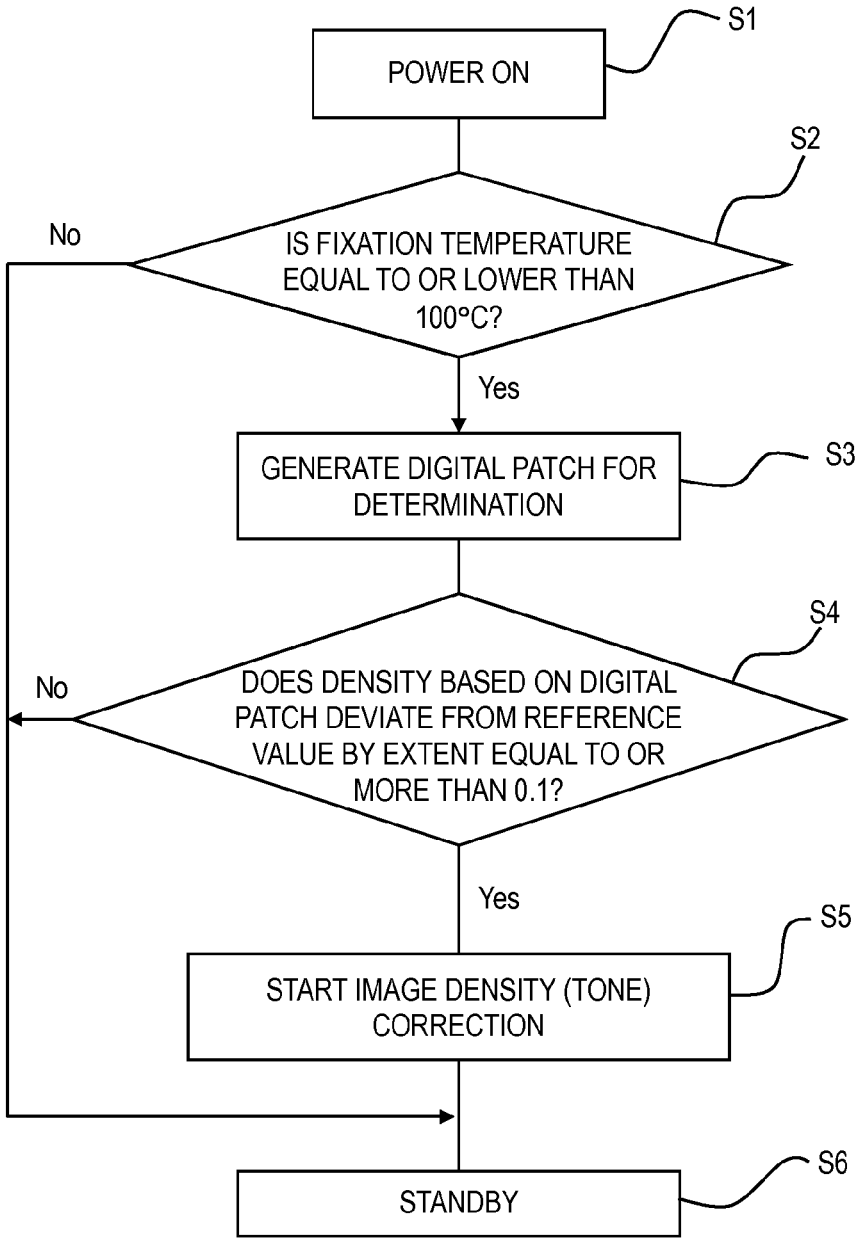
FIG. 5 PRIOR ART
FIG. 5 is a flowchart illustrating conventional image density correction.

FIG. 5 is a flowchart illustrating conventional image density correction about the change of the image density changed in a short time described above. As illustrated in FIG. 5, first, the image forming apparatus 100 is powered on (S1), and it is determined whether or not the fixation temperature is equal to or lower than a predetermined temperature (here, equal to or lower than 100 degree) (S2).

In a case where the fixation temperature is equal to or lower than 100° C. in S2, it is determined that time has elapsed to some extent since the power-off of the image forming apparatus 100, and a digital patch (first patch) for density change determination for detecting the density change with a predetermined development latent image potential Vcont is formed on the photoreceptor drum 10 (S3).

The image density of the formed digital patch is read by the density detecting sensor 28, and it is determined whether or not the image density deviates from a predetermined density by the extent equal to or more than a first predetermined value (equal to or more than 0.1) (S4).

When the image density deviates by the extent equal to or more than the first predetermined value in S4, it is determined that it is necessary to correct the image density, the development latent image potential Vcont is adjusted, the image density (the tone) is corrected (S5), and the process becomes a standby state (S6). The correction of the image density (the tone) in S5 is the known tone density correction control in the embodiment. Specifically, a patch with a plurality of different density levels is formed by the controller 101, and the patch is detected by the density detecting sensor 28. It means that the controller 101 corrects a gamma look-up table so that a desired tone can be obtained based on the detection result at this time.

When the fixation temperature is higher than 100° C. in S2 and when the image density does not deviate by the extent equal to or more than the first predetermined value in S4, the process becomes the standby state as it is (S6).

(Digital Development, Analog Development)

Here, the digital patch means a patch image formed using digital development. The digital development means a method of flying the toner with a predetermined development latent image potential Vcont onto the photoreceptor drum 10 using the exposure device 22 and the development device 1.

On the other hand, the analog patch (second patch) means a patch image formed using analog development. The analog development is a method of performing development based on the development device 1 by changing a difference between the development voltage (the development bias Vdc) and the charging potential of the photoreceptor drum 10 (the photoreceptor potential Vd) substantially without using the exposure device 22. That is, it means a unit that flies the toner toward the photoreceptor drum 10 in a manner that the relation between the photoreceptor potential Vd and the development bias Vdc is different from the relation at the time of the general image forming without exposing the photoreceptor drum 10 by the exposure device 22.

Figure 6:
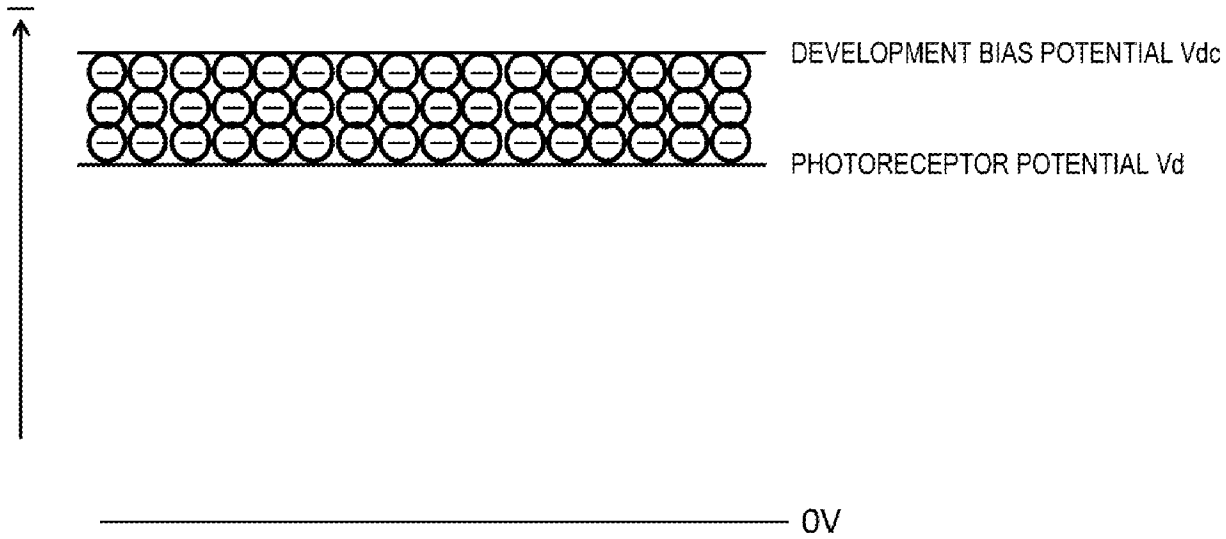
FIG. 6 is a diagram illustrating a principle of analog development.

FIG. 6 is a diagram illustrating a principle of the analog development. Since the toner is negatively charged, the toner moves to a place where the negative potential is relatively lower than that of the development sleeve 8. As illustrated in FIG. 6, when the development bias Vdc is more negative than the photoreceptor potential Vd, the toner on the development sleeve 8 flies to the photoreceptor drum 10 as much as the potential difference between both.

FIG. 7 is a diagram illustrating merits and demerits of the digital development and the analog development. As illustrated in FIG. 7, the digital development is strong in the mechanical change. In addition, the exposure portion potential VL is easily changed by the temperature or the use situation of the photoreceptor drum 10. For this reason, by the digital development, it is possible to form a stable toner image when there is a potential sensor that detects the photoreceptor potential Vd or the exposure portion potential VL. However, in a case where there is no potential sensor, since it is difficult to detect the change of the exposure portion potential VL of the photoreceptor drum 10, it may be difficult to obtain a stable development latent image potential Vcont, and thus reliability of the density of the formed toner image may be low.

Meanwhile, in the analog development, since the exposure portion potential VL is not used, it is possible to form the toner image with a stable potential even when there is no potential sensor. However, differently from the digital development, the analog development has a configuration in which it is difficult to form the latent image by exposure at a predetermined position, and the toner is flown throughout the whole area in the longitudinal direction of the photoreceptor drum 10. In addition, generally, there are many cases where the patch image is formed in a halftone from the viewpoint of sensitivity of the sensor. In this case, in the digital patch, a halftone image is formed by thin lines or dot groups, and the analog patch adjusts the density by changing only the applied amount present in a whole-face solid state. For this reason, the sensitivity of the contrast of the analog development is higher than that of the digital development. For this reason, in the case of the analog development, a small development contrast is used to output the same density as that of the digital development. As a result, the force of being electrostatically attached to the photoreceptor drum 10 becomes weak, and thus it is easy to receive an influence of unevenness based on mechanical change.

Accordingly, as long as the potential sensor is mounted, the density change determination based on the digital development is a unit with the highest reliability. In a large-size image forming apparatus for the commercial printing, for example, the potential sensor is mounted, and the determination based on the digital patch is used.

However, when the image forming apparatus is small in size, there is no place for providing the potential sensor, and thus it is difficult to provide the potential sensor. In addition, since it causes an increase of costs, there is a background on which it is not easy to provide the potential sensor.

In such a case, generally, the change of the image density is determined by any method to the extent that the digital and analog precisions are the same, and the case is a trigger of performing the image density correction control at the time of power-on. However, even though any method is used, the determination of the density change is not reliable. Accordingly, although the density adjustment control is not necessary, the density adjustment control may be performed. The unnecessary control unnecessarily consumes the toner, and thus it is difficult to form the image in a short time from start-up.

In the embodiment, the image density correction control excluding the unnecessary control described above is performed.

(Image Density Correction of Embodiment)

Figure 8:
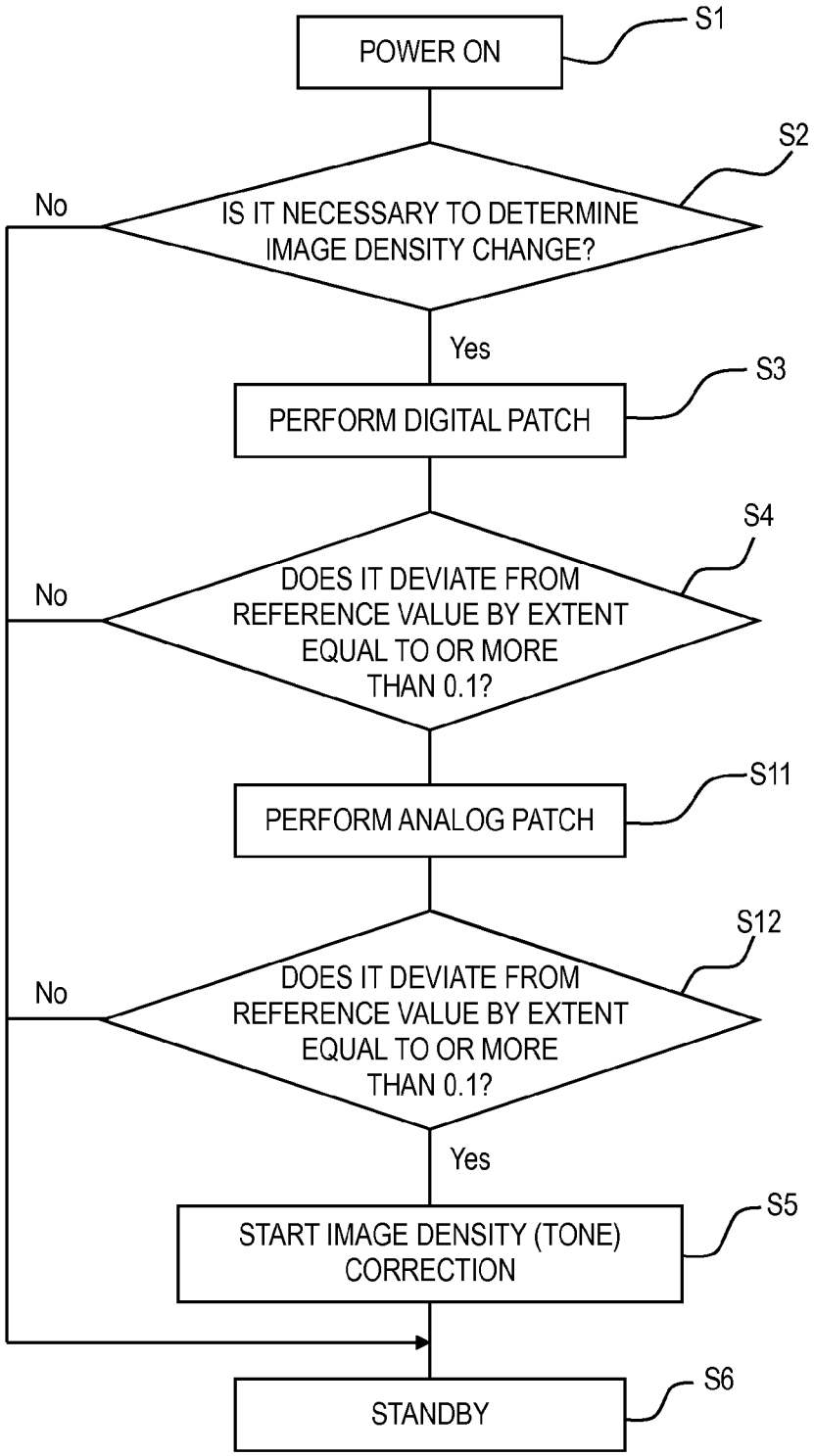
FIG. 8 is a flowchart illustrating image density correction of the first embodiment.

FIG. 8 is a flowchart illustrating the image density correction at the time of starting up the main body in the embodiment. As illustrated in FIG. 8, in the flow of the image density correction of the embodiment, the flows S11 and S12 are inserted between the flows S4 and S5 of the conventional image density correction illustrated in FIG. 5.

That is, first, the image forming apparatus 100 is powered on (S1). Then, it is determined whether or not the image density change is necessary, here whether the fixation temperature is equal to or lower than a predetermined temperature (here equal to or lower than 100 degree) (S2).

When the fixation temperature is equal to or lower than 100° C. in S2, it is determined that time has elapsed to some extent from the power-off of the image forming apparatus 100 and it is necessary to determine the image density change. A digital patch for density change determination to detect density change with a predetermined development latent potential Vcont is formed on the photoreceptor drum 10 (S3).

The image density of the formed digital patch is read by the density detecting sensor 28, and it is determined whether or not the image density deviates from a predetermined density by the extent equal to or more than a first predetermined value (here equal to or more than 0.1) (S4).

When the image density deviates by the extent equal to or more than the first predetermined value in S4, an analog patch is formed (S11). The image density of the formed analog patch is read by the density detecting sensor 28, and it is determined whether or not the image density deviates from a predetermined density by the extent equal to or more than a second predetermined value (here equal to or more than 0.1) (S12).

When the image density deviates by the extent equal to or more than the second predetermined value in S12, the image density deviates even in the digital development and even in the analog development, and thus it is determined that the toner density is substantially certainly changed even considering various changes. In this case, it is determined that it is necessary to correct the image density, the image density (the tone) is corrected (S5), and the process becomes the standby state (S6). In addition, the correction of the image density (the tone) in S5 means forming a patch of a plurality of different density levels and correcting a gamma look-up table to obtain a desired tone. As described above, in the tone correction control, the patch with the plurality of density levels is formed to perform the density correction, and thus it is possible to reliably correct the tone density although the toner consumption and the control time are increased.

When the fixation temperature is higher than 100° C. in S2, and when the image density does not deviate by the extent equal to or more than the predetermined value in S4 and S12, the process becomes the standby state as it is (S6). That is, when at least one density of the digital patch and the analog patch does not deviate from each of the preset densities by the extent equal to or more than the predetermined value, the tone density correction performed in S5 is not performed. For this reason, it is possible to suppress the unnecessary toner consumption and down-time.

By the flow of the image density correction of the embodiment, even in a case of the image forming apparatus which is not provided with the potential sensor, only when the density is certainly changed, it is possible to perform the control of the toner density correction, and it is possible to suppress to use the unnecessary time and toner at the time of starting-up.

FIG. 9 is a diagram illustrating an effect of the embodiment. FIG. 9 illustrates the change of the actual image density with respect to the digital and analog patch density changes.

As illustrated in FIG. 9, when only one of the digital and analog density changes is detected, the actual toner density is not substantially changed. In addition, when any one of the densities is not changed, obviously the actual toner density is not changed. On the other hand, when both of the digital and analog densities are changed, it is found that the actual toner density is changed.

As described above, it is possible to reliably determine the change of the density by using both of the digital patch and the analog patch, and thus it is possible to suppress the unnecessary control time and toner consumption.

In addition, as described in the embodiment, it is possible to shorten the time by performing the digital patch before the analog patch. The reason is because, in a case of the digital patch of the charging and development potential such as the normal image forming state, when there is no density change, it is possible to transfer to the print operation as it is. However, the reason is because, in a case of the analog patch of the charging and development potential different from the normal image forming operation, after it is determined that there is no density change, the time to return the charging and development high-voltage to the relation of the normal image forming state is necessary.

From the description, it is possible to efficiently achieve start-up and printing start of the main body in a short time and stabilization of an image density.

In addition, in the embodiment, the configuration of directly transferring the toner of the photoreceptor drum 10 to the sheet has been described, but the invention is not limited to the configuration described above. For example, a configuration may be used in which, using an intermediate transfer member, the toner image transferred to the intermediate transfer member once is transferred to the sheet. In addition, a threshold value of the density change is set as 0.1, but there is no limit.

Second Embodiment

Next, an image forming apparatus according to a second embodiment of the invention will be described with reference to the drawings. The same reference numerals and signs are given to the portions overlapped with the description of the first embodiment, and the description thereof will not be made.

In the image forming apparatus according to the embodiment, various abnormal states are detected by combination of detection results of a digital patch and an analog patch, it is determined whether or not to perform a control and a kind of control to be performed later to perform an appropriate control, in addition to the image density correction of the first embodiment.

FIG. 10 is a diagram illustrating combination of detection results of the digital patch and the analog patch detected in the flowchart of FIG. 8 of the first embodiment, and controls thereof.

As illustrated in FIG. 8, (1) when the density change appears in both of the digital patch and the analog patch, a density correction control is performed in the first embodiment.

(2) When the density change appears only in the analog patch, probability that unevenness caused by mechanical change occurs is high. For this reason, a control of correcting the unevenness is performed. As the control of correcting the unevenness, for example, a cycle of the unevenness is calculated from a signal result of the analog patch, and levels of the image densities are given so that the actual image formation corresponds to the unevenness. In addition, an alarm of encouraging maintenance may be displayed to remove a cause of the mechanical change by the maintenance.

(3) When the density change appears only in the digital patch, the change of the exposure portion potential VL of the photoreceptor drum 10 based on the temperature change of the photoreceptor drum 10 is suspected. For this reason, the current temperature around the photoreceptor drum 10 is detected, a difference from a reference temperature is acquired, and the exposure portion potential VL is adjusted.

Figure 11:
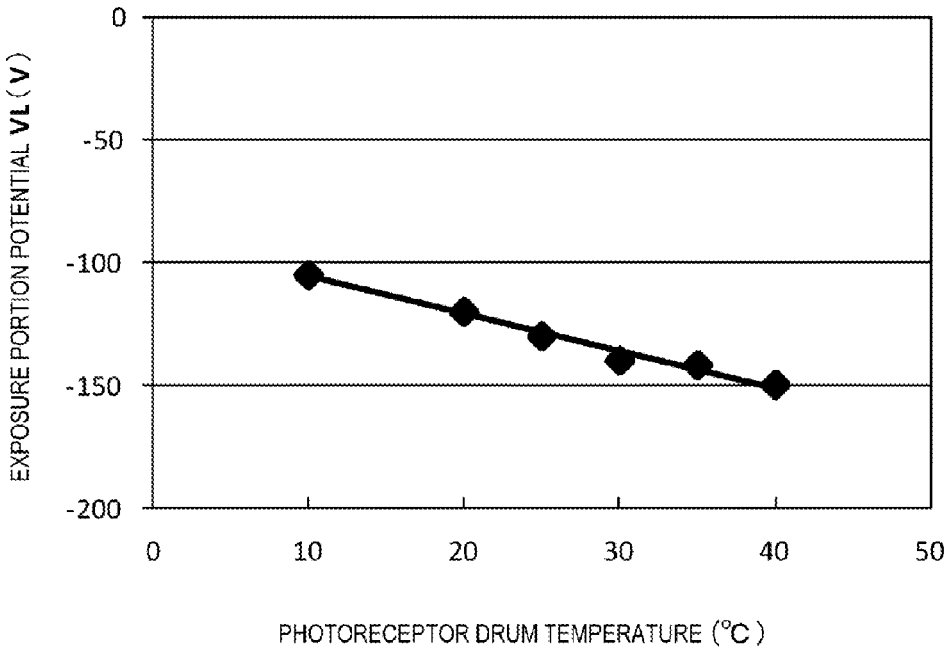
FIG. 11 is a diagram illustrating a relation between a temperature of a photoreceptor drum and a potential of an exposure portion.

FIG. 11 is a diagram illustrating a relation between the temperature of the photoreceptor drum 10 and the exposure portion potential VL when the photoreceptor potential Vd is −700 V. As illustrated in FIG. 11, as the temperature of the photoreceptor drum 10 is increased, the exposure portion potential VL is further shifted to the photoreceptor potential Vd. From this approximate curve, deviation from the reference exposure portion potential VL at the current temperature is calculated, and the deviation is fed back to form an actual image. For example, when 20° C. is the reference, the exposure portion potential VL rises by 30 V with respect to the time of the reference temperature when the temperature of the photoreceptor drum 10 is 40° C. Accordingly, when the photoreceptor drum 10 is 40° C., the output of the exposure is raised so that the exposure portion potential VL is −130 V.

(4) When there is no density change in both of the digital patch and the analog patch, the control is not particularly performed.

Figure 12:
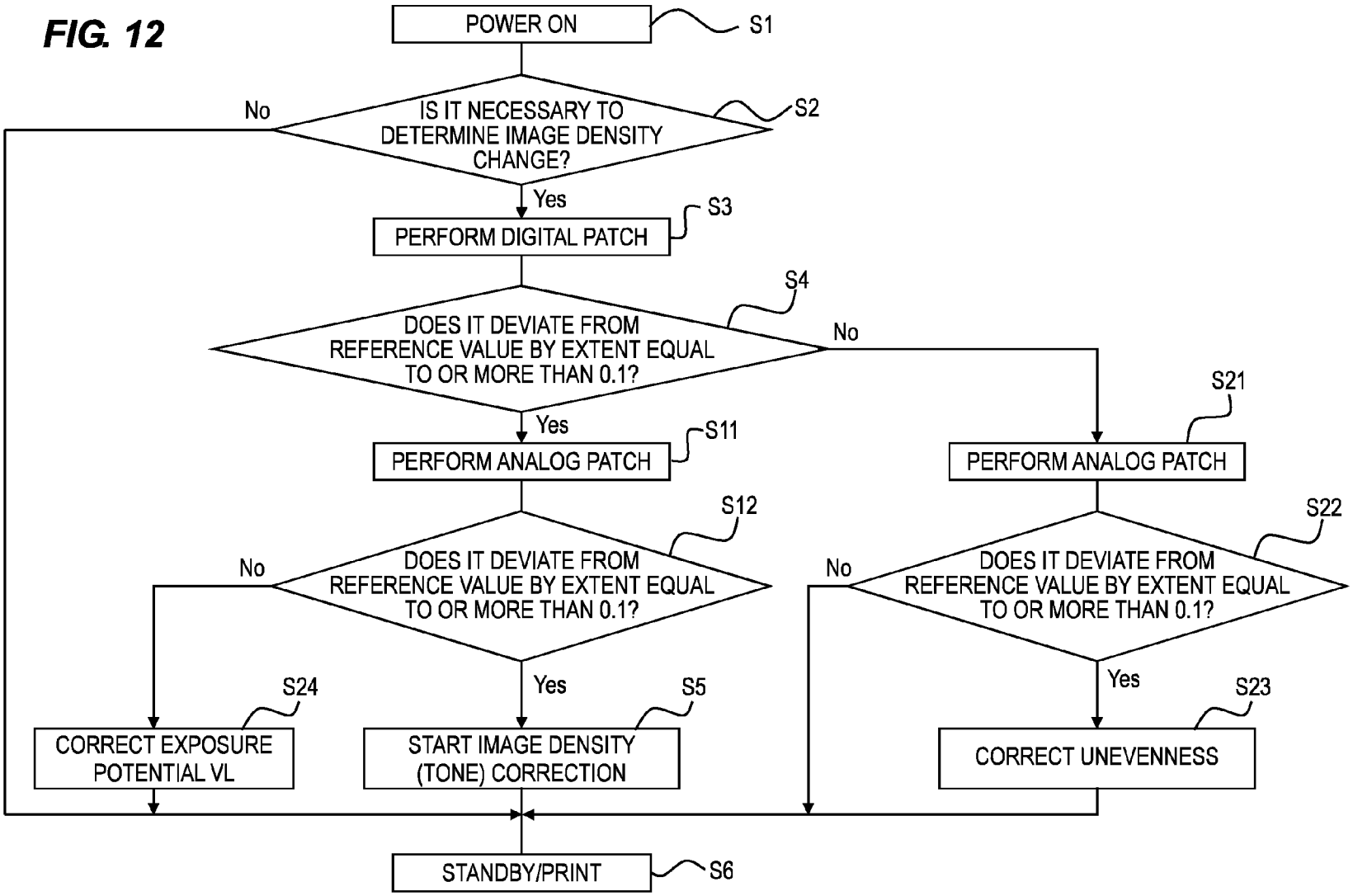
FIG. 12 is a flowchart illustrating image density correction of a second embodiment.

FIG. 12 is a flowchart illustrating image density correction of the second embodiment. As illustrated in FIG. 12, in the flow of the image density correction of the embodiment, the flows of S21 to S24 are added to the flow of the image density correction of the first embodiment illustrated in FIG. 8.

As illustrated in FIG. 12, when the image density does not deviate by the extent equal to or more than the first predetermined value in S4 same as that of the first embodiment, an analog patch is formed (S21). The image density of the formed analog patch is read by the density detecting sensor 28, and it is determined whether or not the image density deviates from a predetermined density by the extent equal to or more than the second predetermined value (here equal to or more than 0.1) (S22). When the image density deviates by the extent equal to or more than the second predetermined value in S22, it is determined that unevenness caused by mechanical change occurs since the density is changed only in the analog patch, the unevenness is corrected (S23), and the process becomes the standby state or printing is started (S6).

When the image density does not deviate from equal to or more than the second predetermined value in S22, there is no density change in either of the digital patch or the analog patch, and thus the process becomes the standby state or printing is started (S6).

When the image density does not deviate by the extent equal to or more than the second predetermined value in S12 same as that of the first embodiment, the density is changed only in the digital patch, and thus it is determined that the exposure portion potential VL of the photoreceptor drum 10 is changed by the temperature change of the photoreceptor drum 10. The current temperature around the photoreceptor drum 10 is detected, a difference from the reference temperature is acquired, the exposure portion potential VL is corrected (S24), and the process becomes the standby state or printing is started (S6).

According to the embodiment, as well as the density change is detected as described in the first embodiment, various problems are assumed from the combination of the digital patch and the analog patch, and it is possible to automatically improve the problems and to urge a user or a service man to handle maintenance.

According to the invention, it is possible to efficiently achieve start-up and printing start of the main body in a short time and stabilization of the image density.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-190040, filed Aug. 30, 2012, which is hereby incorporated by reference herein in its entirety.

What is claimed is:

1. An image forming apparatus, comprising:

a photoreceptor body;

a charging device that charges the photoreceptor body;

an exposure device that exposes the photoreceptor body to form an electrostatic latent image;

a development device that develops the electrostatic latent image as a toner image using a toner;

a density detection sensor configured to detect density of an image, the density detection sensor having a light emitting element for emitting light and a light receiving element for receiving a reflection reflected from the image when the light emitting element emits light to the image; and a controller configured to selectively execute a correction mode in a warm-up period from power-on of a main body of the image forming apparatus until allowing an image to be formed on a recording medium, the controller corrects a gamma look-up table based on detection results of a plurality of image patches having different densities from each other detected by the density detection sensor in the correction mode;

wherein the controller forms a first image in the warm-up period and then forms a second image in a case when a first detection result obtained by detecting the first image with the density detection sensor is out of a first predetermined range, wherein the controller allows an image to be formed on a recording medium without executing the correction mode in a case when the first detection result is within the first predetermined range or a second detection result obtained by detecting the second image with the density detection sensor is within a second predetermined range, the controller executes the correction mode in a case when the first detection result and the second detection result are out of the first predetermined range and the second predetermined range, respectively;

wherein the first image is a toner image obtained by a potential difference between a DC developing bias applied to the developing device and a potential of a surface of the photoreceptor body being exposed by the exposure device after being charged by the charging device, and the second image is a toner image obtained by a potential difference between a DC developing bias applied to the developing device and a potential of the surface of the photoreceptor body, without being substantially exposed by the exposure device after being charged by the charging device.

2. The image forming apparatus according to claim 1, wherein the charging bias and the developing bias established in forming the first image are the same as in forming an image on the recording medium.

3. The image forming apparatus according to claim 1, wherein when the detection result obtained by detecting the first image with the density detection sensor is out of the first predetermined range and the detection result obtained by detecting the second image with the density detection sensor is within the second predetermined range, the controller corrects an exposing amount of the exposure device without executing the correction mode.

4. The image forming apparatus according to claim 1, wherein when the detection result obtained by detecting the first image with the density detection sensor is within the first predetermined range and the detection result obtained by detecting the second image with the density detection sensor is out of the second predetermined range, the controller outputs information that maintenance is necessary without executing the correction mode.

5. The image forming apparatus according to claim 1, wherein when the detection result obtained by detecting the first image with the density detection sensor is within the first predetermined range, the controller does not execute the correction mode without forming the second image.

6. The image forming apparatus according to claim 1, further comprising a fixing device which fixes a toner image formed on the photoreceptor body to the recording medium and a temperature sensor which detects temperature of the fixing device, wherein the controller decides whether to form the first image or not according to a detecting result by the temperature sensor.

* * * * *